US006528114B1

(12) United States Patent
Summons

(10) Patent No.: US 6,528,114 B1
(45) Date of Patent: Mar. 4, 2003

(54) METHOD AND SYSTEM FOR APPLYING A COATING TO RECESSED AND POORLY ACCESSIBLE WOOD SURFACES

(75) Inventor: Wayne L. Summons, Thornton, CO (US)

(73) Assignee: Sashco, Inc., Brighton, CO (US)

( * ) Notice: Subject to any disclaimer, the term of this patent is extended or adjusted under 35 U.S.C. 154(b) by 0 days.

(21) Appl. No.: 09/660,983

(22) Filed: Sep. 13, 2000

(51) Int. Cl.[7] ..... B05D 7/06
(52) U.S. Cl. ..... 427/230; 427/236
(58) Field of Search ..... 427/230, 236, 427/243, 244

(56) References Cited

U.S. PATENT DOCUMENTS

| | | | | |
|---|---|---|---|---|
| 3,816,610 A | | 6/1974 | Lusby | |
| 4,889,710 A | | 12/1989 | Hagarty | |
| 5,346,699 A | | 9/1994 | Tiernan et al. | |
| 5,695,823 A | * | 12/1997 | Hsu et al. | 427/370 |
| 5,804,641 A | | 9/1998 | Iwakawa | |
| 6,316,016 B1 | * | 11/2001 | Iwakawa | 427/409 |

OTHER PUBLICATIONS

Jeffrey J. Morrell, Mark Newbill, Robert D. Graham; "Evaluation of Protective Treatment for Field–Drilled Holes"; Nov./Dec. 1990; pp. 49 & 50.

The inventor is aware of a commercially available product called "Dispos'l Clean" (distributed by Scot Laboratories, of Chagrin Falls, Ohio) that is an aerosol–applied, foaming anti–bacterial compound for sterilizing the enclosed region of a drain below a sink and above a garbage disposal. The foam allows the anti–bacterial agents of the compound to come into contact with all the enclosed surfaces. (no date).

* cited by examiner

*Primary Examiner*—Katherine A. Bareford
(74) *Attorney, Agent, or Firm*—Holland & Hart LLP

(57) ABSTRACT

A method of applying a coating, such as a substantially waterproof coating, to a wood surface using a collapsing foam coating material. The material is initially sprayed onto a recessed wood surface, whereupon the resin material foams and collapses over a relatively short period of time into a film coating or layer that penetrates and seals the wood surface. A delivery system for applying the coating is also disclosed.

11 Claims, 13 Drawing Sheets

METHOD AND SYSTEM FOR APPLYING A COATING TO RECESSED AND POORLY ACCESSIBLE WOOD SURFACES

FIELD OF THE INVENTION

The present invention generally relates to a method and system for applying a coating, such as a substantially waterproof coating, to wood surfaces, especially to recessed and poorly accessible surface regions formed by checks, cracks, cuts, crevices, holes and the like.

BACKGROUND OF THE INVENTION

Many wood objects, such as logs for log homes, utility poles, railroad ties, marine pilings, wooden bridge structures, and timber fences, are usually placed in outdoor environments in which the wooden objects are subjected to deteriorating forces such as sunlight, water, fungi and insects.

The foregoing types of wood objects are often surface-coated with weatherproofing paints, stains, and clear sealers, which often contain biocides (i.e., fungicides, algaecides and sometimes insecticides). Such coatings are most often applied conventionally by spraying or brushing, or, less frequently, by dipping the wooden object into a vat of liquid coating, which later hardens and develops its full physical properties. When such coatings are applied to the wood they usually or often perform their intended function and protect the coated wood from UV and visible radiation, water damage, and biological attack from fungi, algae and insects. However, wooden objects used outdoors often suffer from checks, cracks, holes and other similar features, with such crevices having recessed surfaces exposed to environmental effects (like, for example, collecting water) that frequently do not get coated when the rest of the object is surface-treated (via spray or brush) with a paint, stain, or clear sealer. Moreover, even when such wooden objects are initially dip-treated (and dip-treating does allow contact of a coating with all initially-existing recessed surfaces) they frequently develop checks and cracks at a later date (or have holes drilled into them by humans or eaten into them by insects) that then expose bare and vulnerable wood to the deteriorating effects of the environment.

In the log home industry, for example, several methods have been attempted to alleviate this problem. One method is to attempt spraying (with an airless sprayer or garden sprayer) a conventional coating into a check (usually the same coating used on the largely exposed and easily accessible exterior wooden surfaces of the log building) and coat the bare wood that comprises the inner sidewalls of the check. This approach has only limited effectiveness because many checks exist as a labyrinthine maze of contours and rough wood fibers and splinters that are difficult or impossible to coat directly with a spray, and often many such internal surfaces are left uncoated and unprotected.

Another approach used in the log home industry is to seal the larger checks (i.e., those about ⅜" in width and larger) with elastomeric sealants, such as caulking or synthetic chinking, ideally preceded with round backer rod. Such caulking or chinking frequently suffers from failure because the inner lips of the check side walls are often poorly cleaned, or the sealant, when installed, is not well tooled, both of which problems can lead to adhesive failure of the sealant. Also, even when the sealant is well tooled and otherwise well installed, checks can continue to greatly open up over time, especially when "green" logs are used, which frequently results in excessive sealant stress and sealant failure.

Still another approach that has been occasionally and unsuccessfully tried in the log home industry is to apply foaming sealants (that retain a rigid and permanent foam structure as the sealant solidifies—such as urethane foams). Such foam sealants are only well suited to applications within wall structures that are not exposed to exterior weather. When used where they are exposed to exterior weather, they typically deteriorate quickly, exhibit poor aesthetics, cannot handle the level of movement experienced by wood as it undergoes thermal and moisture cycling, and can actually trap moisture within the structure. Consequently, this approach is seldom, if ever, attempted any more.

SUMMARY OF THE INVENTION

The present invention generally relates to a method of applying a coating, such as a substantially water and weather proof coating, to recessed and poorly accessible wood surfaces using a collapsing foam coating material. The coating is initially sprayed into a recess in a wooden object (such as a check in a log on a log home), whereupon the coating immediately and vigorously foams up and forces the active ingredients of the coating (i.e., resins, water repellents, biocides, etc.) to come into complete and intimate contact with all the internal surfaces contained within the recess, with the foam subsequently collapsing in a relatively short period of time into a fluid that penetrates and seals all contacted wood surfaces. Because of the foaming action, the coating is forced into contact with, and seals all the surfaces of such hard to reach recesses in a way not possible with any other approach. Moreover, once the foam collapses and the coating becomes a thin liquid, the fluid flows by gravity into the most remote regions of the recess, puddles there, soaks in, and ultimately cures to offer the maximum possible protection to the wood where water is also most likely to flow, accumulate and otherwise cause damage.

BRIEF DESCRIPTION OF THE DRAWINGS

The present invention will be described with reference to the accompanying drawings wherein.

DESCRIPTION OF PREFERRED EMBODIMENT

Figure 1:
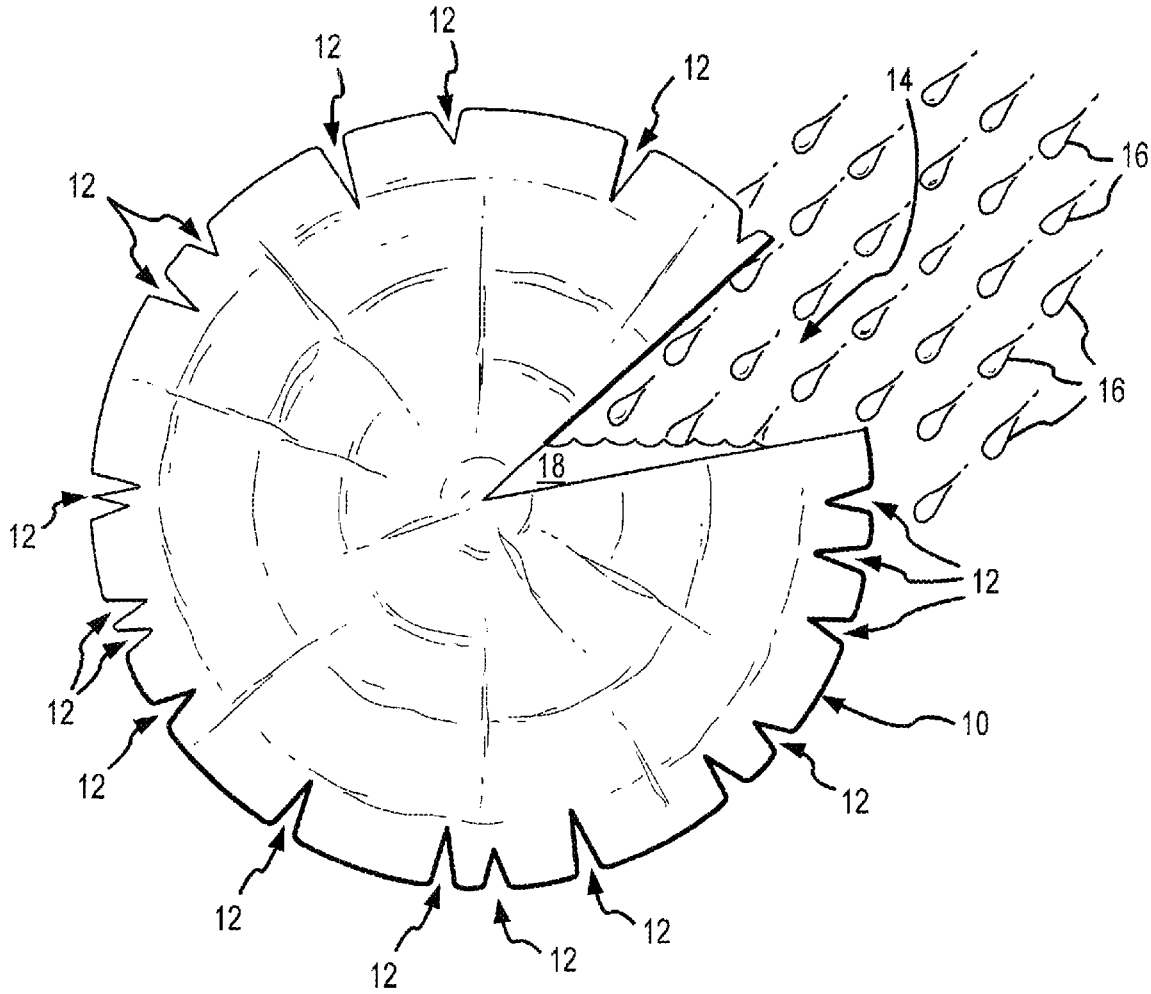
FIG. 1 is a schematic, cross sectional view of a wood log having an exaggerated check longitudinally extending therealong and extending substantially radially outwardly from the center of the log and illustrating how rainwater might collect in the check.

The present invention will be described with reference to the accompanying drawings, wherein like reference numerals refer to the same item.

There is shown in FIG. 1 a cross sectional view of a wood log 10. The log 10 possesses a generally cylindrical peripheral surface which possesses a series of longitudinally extending checks 12 generally recessed radially inward. The log 10 also possesses a very large, exaggerated check 14 extending radially inward from the peripheral surface of the log 10 to the center of the log 10. The present invention will be described in connection with the exaggerated check 14, however, it should be appreciated that the invention may be used to equal advantage with much smaller checks. Also, even though the invention is described with reference to a check in a log, the invention may be advantageously employed with crevices, cracks, cuts, holes, and other wood surfaces recessed interiorly of the peripheral surface of a wood object.

As shown in FIG. 1, a plurality of rain droplets 16 may impinge upon the log and may collect in a relatively low (gravitationally low) region within the exaggerated check 14. The collected rainwater may even form a puddle 18 in the region of collection. It will be appreciated from reviewing FIG. 1 that if the wood surface defining the exaggerated check 14 is not well coated with a waterproof seal, the rainwater will soak into the log 10, especially below the puddle 18. Those skilled in the art will appreciate that such an intrusion of water into the log 10 will cause deterioration of the log 10.

Figure 2:
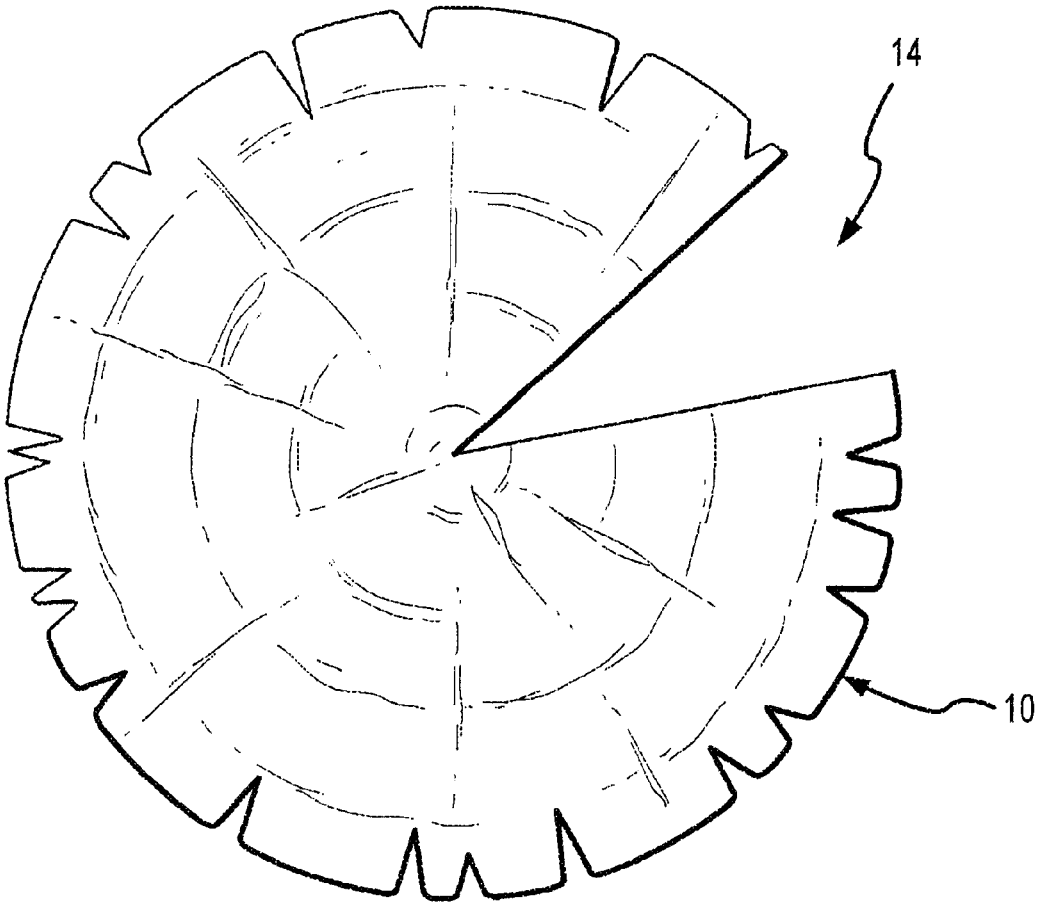
FIG. 2 is the same drawing as FIG. 1, without the illustration of rainwater.

FIG. 2 shows the log 10 of FIG. 1 without rainwater impinging upon the log 10. It will be appreciated from viewing FIG. 2 that the exaggerated check 14 may provide a harbor for fungi, insects, and even rodents, which can cause further deterioration of the wood surface in the vicinity of the exaggerated check 14.

Figure 3:
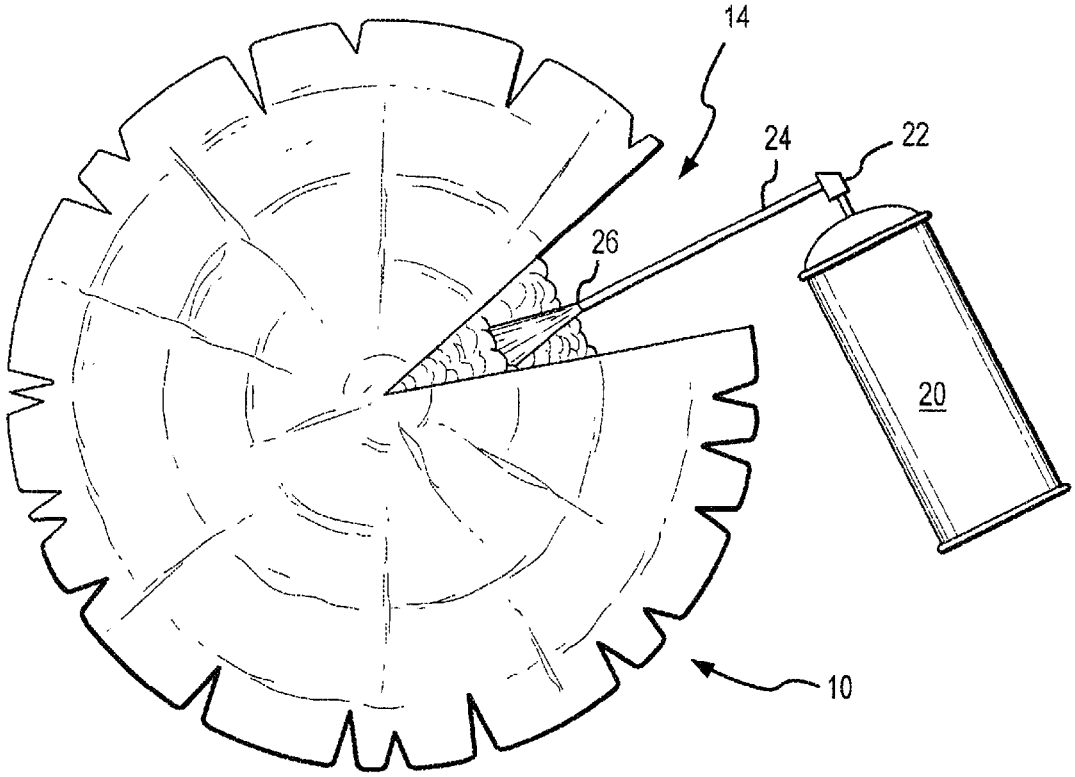
FIG. 3 is the same drawing as FIG. 2 illustrating the delivery system according to one embodiment of the present invention.

FIG. 3 illustrates the use of a delivery system that may be used in accordance with the present invention. The delivery system may include an aerosol container, which includes a metal can or other vessel 20 for containing the coating material (including a foaming agent) under pressure, a manually actuated valve 22 located at the top of the vessel 20, and an elongated tube 24 having a distal end 26 extending away from the valve 22. The delivery system, except for the coating material and foaming agent, is very similar to conventional aerosol containers such as those known under the brand name "WD-40". Such a delivery system may be operated in a well-known manner. By manually depressing the valve 22, the valve 22 is opened, whereby pressurized fluid from within the vessel 20 passes through the elongated tube 24 and out the tube's distal end 26. When the valve 22 is not depressed, the valve 22 is closed and will not permit the fluid within the vessel 20 to flow through the elongated tube 24.

Preferably the elongated tube 24 is cylindrically fashioned of a substantially rigid material. The tube 24 preferably possesses a length of between approximately one to five inches, and more preferably about two to four inches. The outer diameter of the tube 24 is preferably about 3/32 inches, whereas the inner diameter of the tube 24 is preferably about 1/32 inches. The present invention contemplates that the region of the tube 24 near the distal end 26 preferably will be small relative to the types of checks, etc. in connection with which the delivery system is intended for use.

Figure 4:
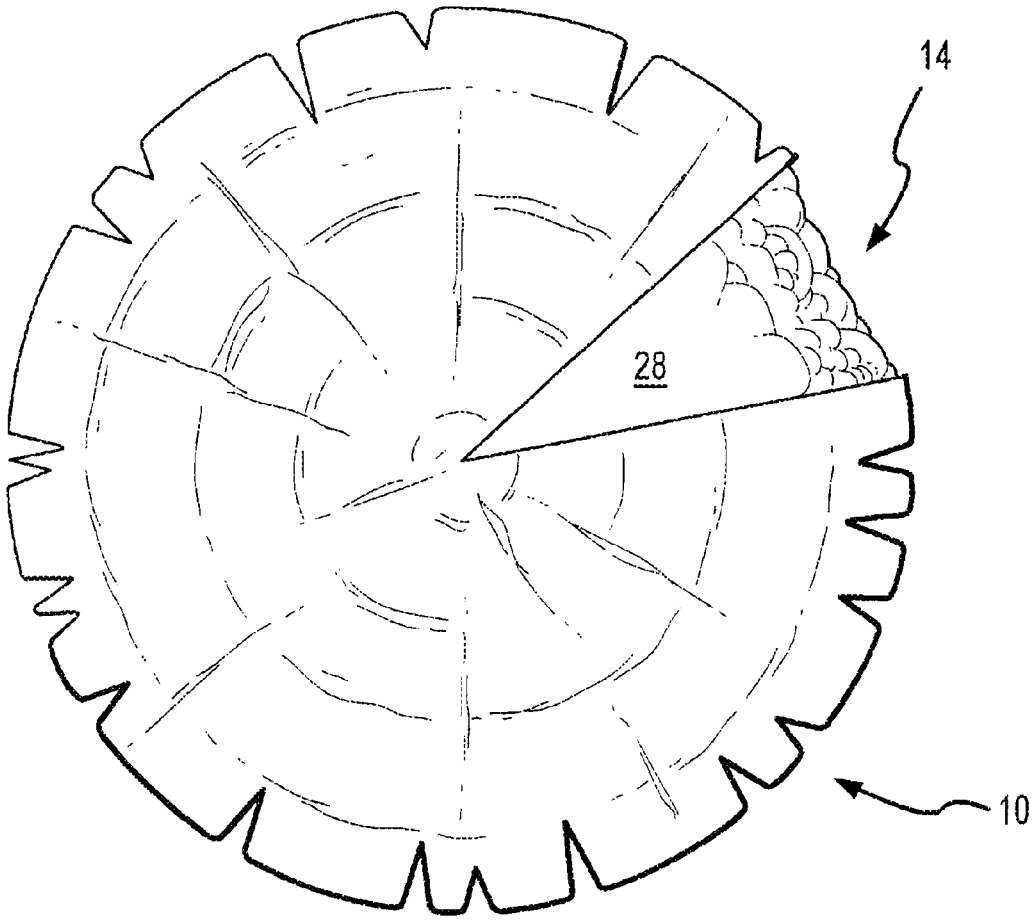
FIG. 4 is the same drawing as FIG. 3 illustrating how the coating material foams after being delivered by the delivery system into the check.

As shown in FIG. 3, the distal end 26 of the elongated tube 24 is placed deep within, although not to the fullest depth of, the exaggerated check 14. The valve 22 is manually depressed and the coating material (including the foaming agent) is delivered through the elongated tube 24, out the distal end 26 initially as a spray, and toward the inner most region of the elongated check 14, whereupon the coating material immediately foams. A sufficient quantity of the coating material is sprayed into the elongated check 14 so that the foam 28 substantially completely fills the elongated check 14, as shown by FIG. 4. The coating material generally foams to a volume substantially in the range of two to two hundred times the volume of the coating material as contained in the vessel 20, and for certain applications to a volume substantially in the range of four to ten times such volume, and for other applications to a volume substantially in the range of two to twenty times such volume.

Figure 5:
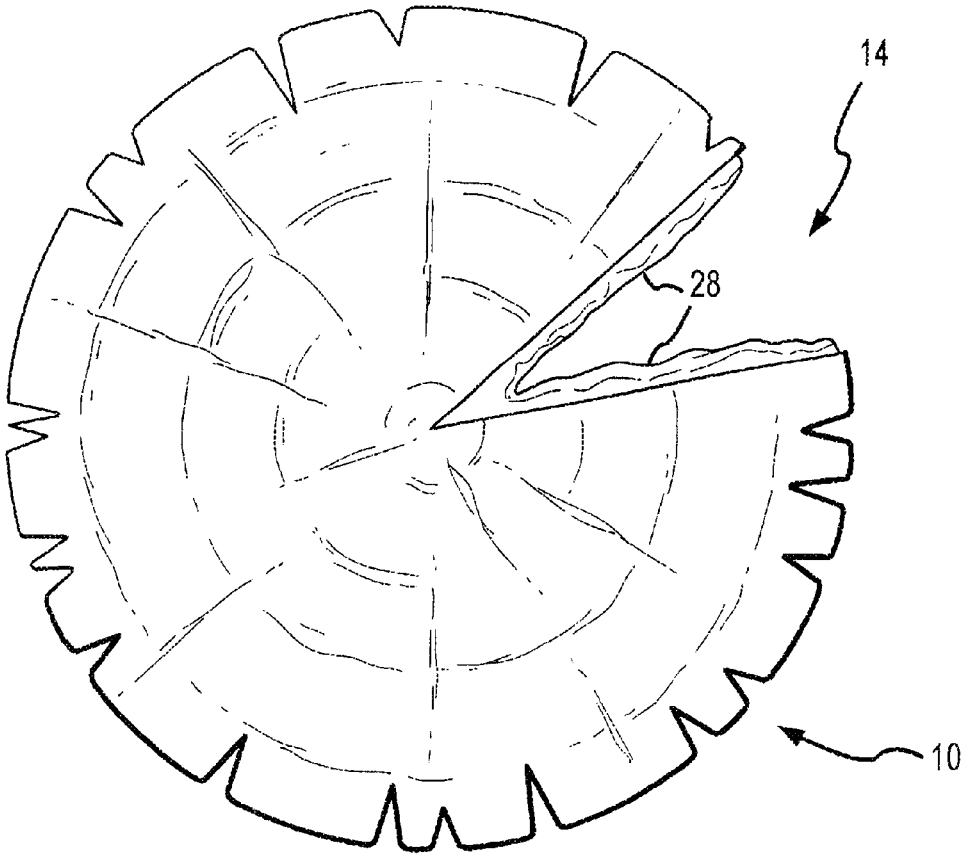
FIG. 5 is the same drawing as FIG. 4 after the foamed coating material has substantially collapsed, while still in a partially foamed state.

As shown in FIG. 5, the foam 28 generally collapses while adhering to the wood surface in the region of the elongated check 14, while leaving a void in the central region of the check 14 away from the wood surface defining the check 14.

Figure 6:
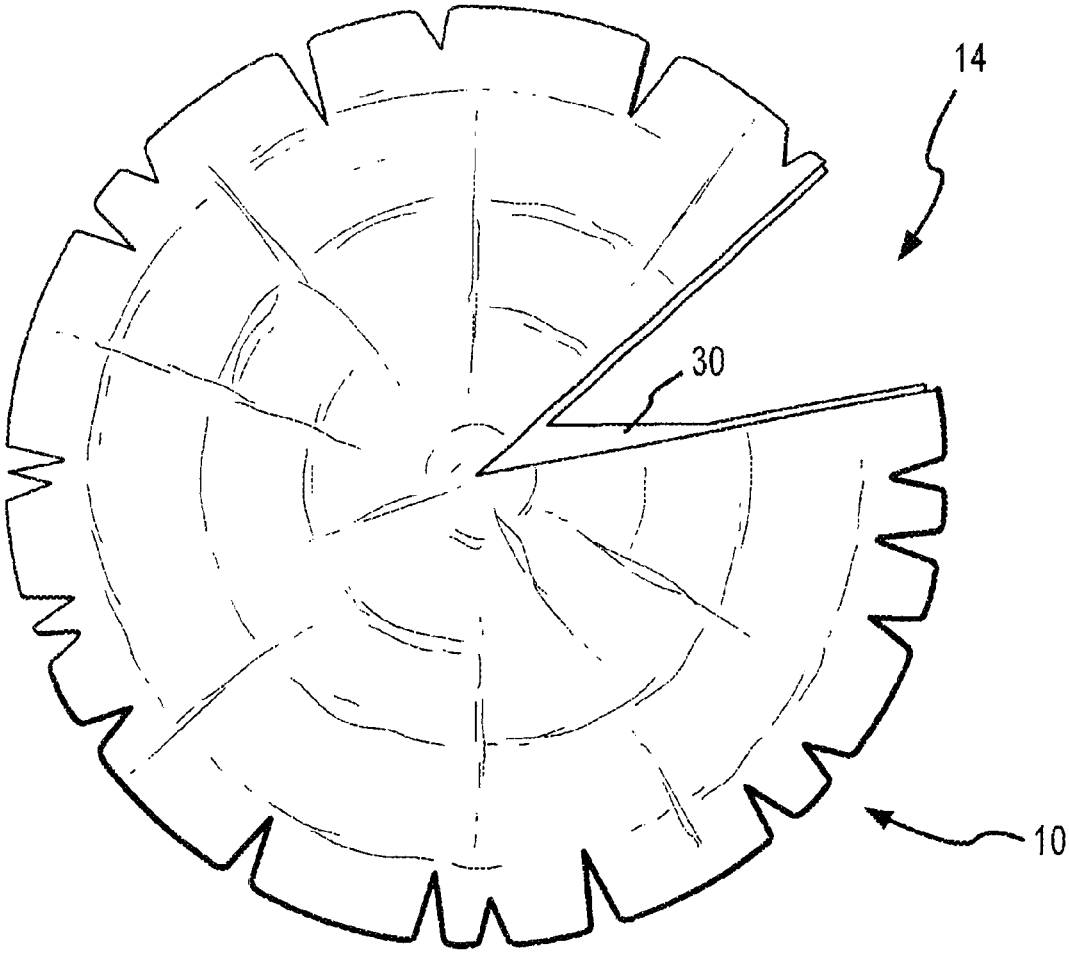
FIG. 6 is the same drawing as FIG. 5 showing a further collapse of the foamed resin material in which there is substantially no foam and in which the resin material to some degree collects at a low point in the check due to gravity.

The foam 28 will, preferably within a matter of about three minutes to about four hours, collapse to an essentially thin liquid state, as shown in FIG. 6. When in such liquid state, the coating material will generally adhere to and penetrate within the wood surface defining the elongated check 14. From a review of FIG. 6, it will also be appreciated that the foam 28, after collapse to a liquid state, will tend to form a puddle 30 in the relatively low (gravitationally low) regions of the elongated check 14. Such a puddle 30 provides a relatively thicker coating or layer in the region where water might collect or puddle, as illustrated in FIG. 1.

Figure 7:
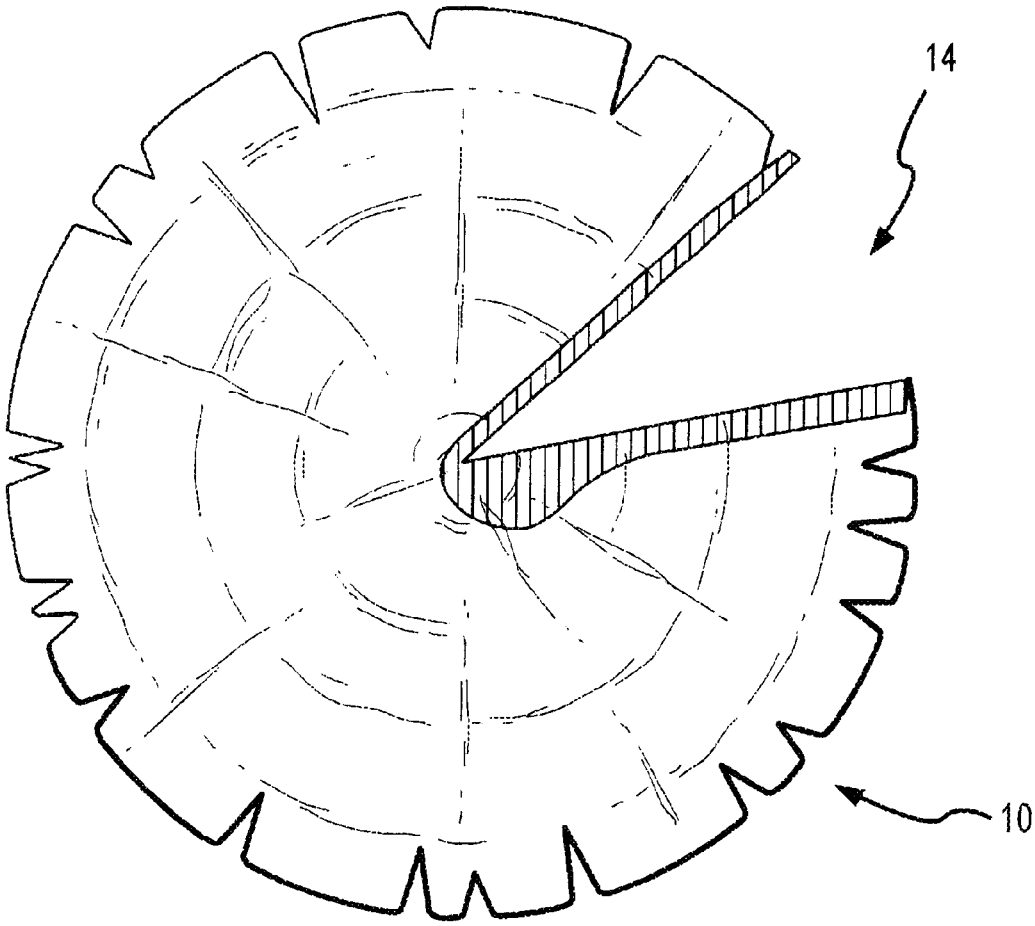
FIG. 7 is the same drawing as FIG. 6 showing how the coating material penetrates and seals the wood surface in the vicinity of the check as the coating material hardens.
Figure 8:
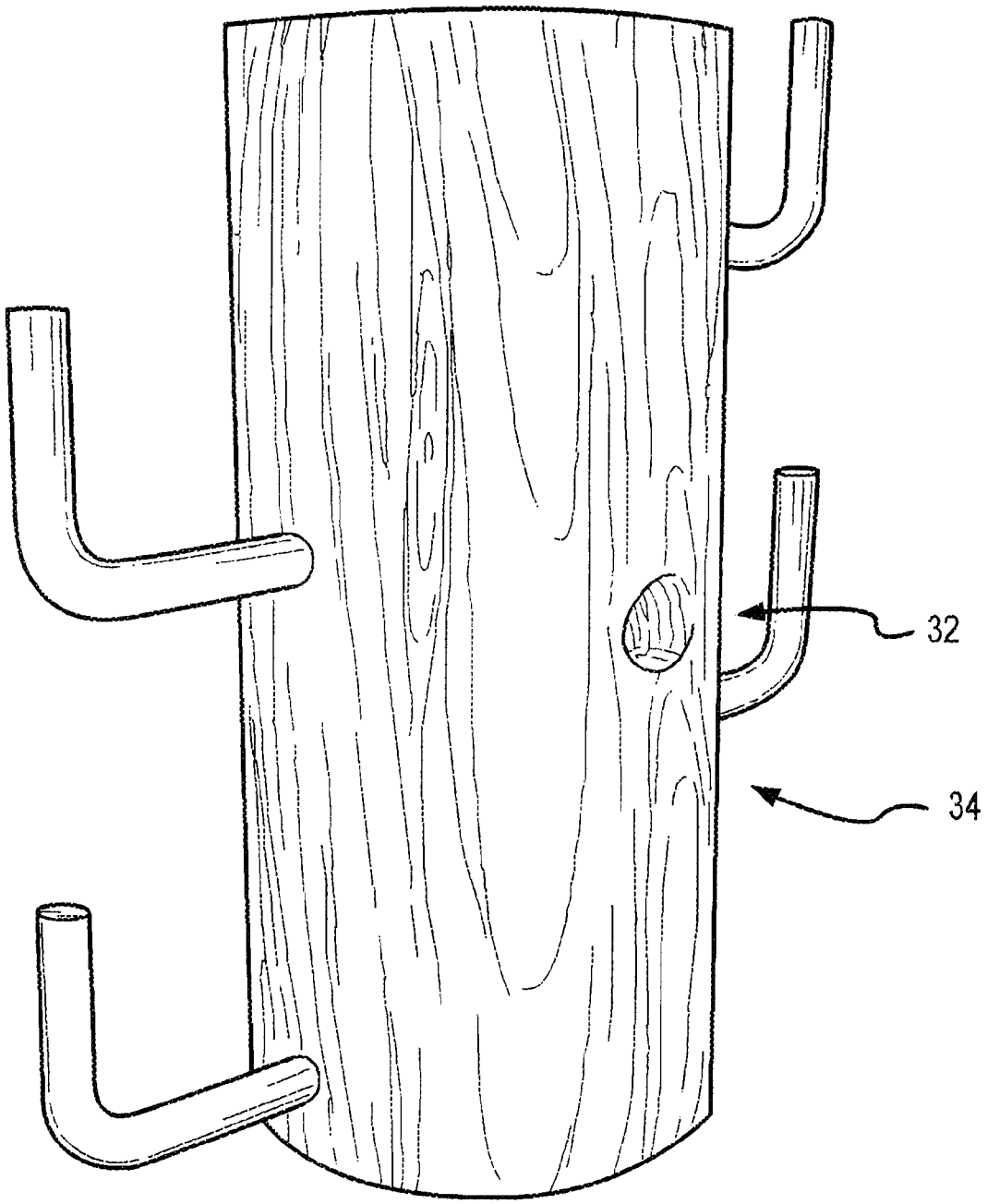
FIG. 8 is a partial schematic illustration of a utility pole in which a hole has been drilled horizontally therethrough.
Figure 9:
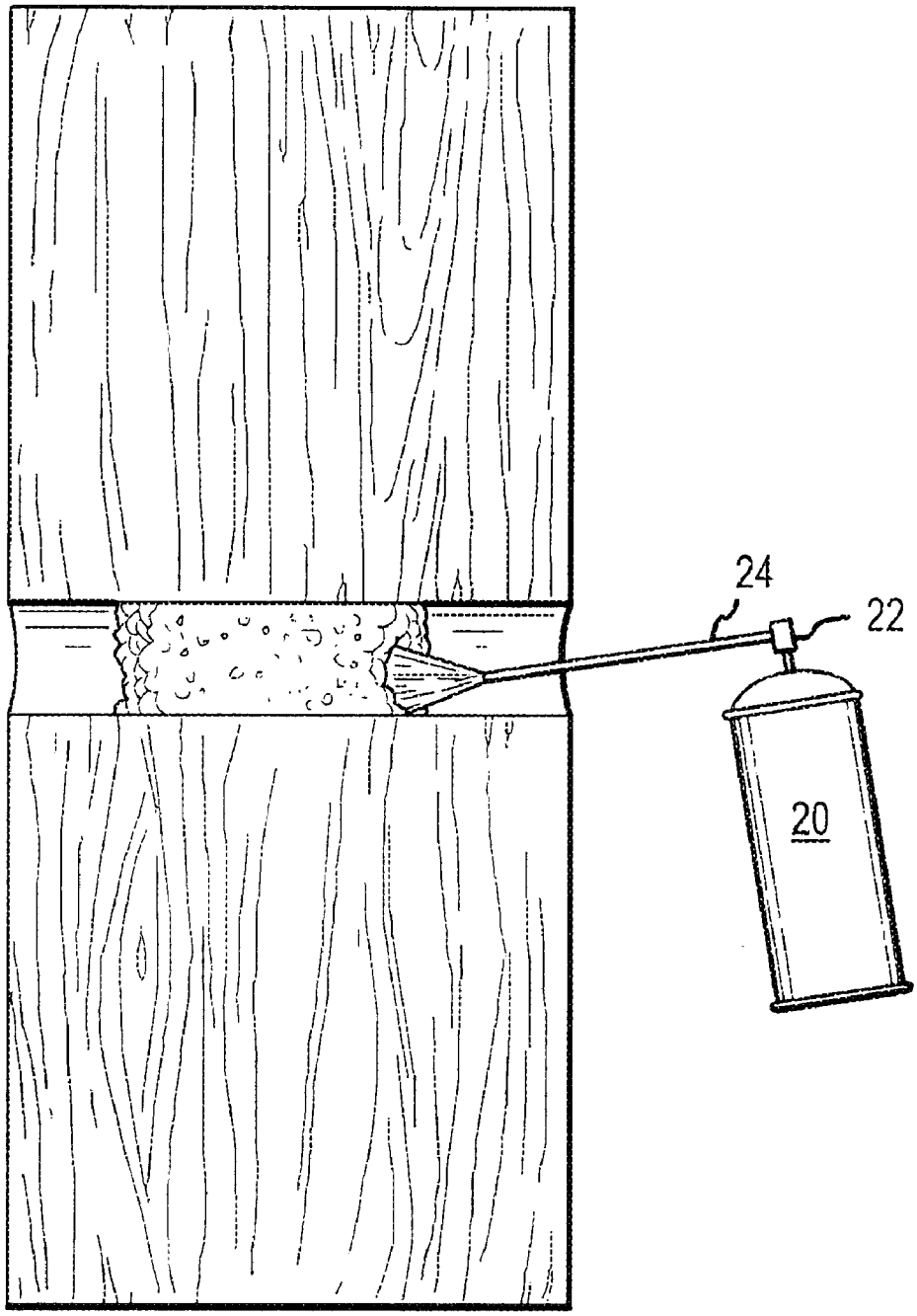
FIG. 9 is an illustration of the utility pole shown in FIG. 8 depicting the delivery system according to one embodiment of the present invention.
Figure 10:
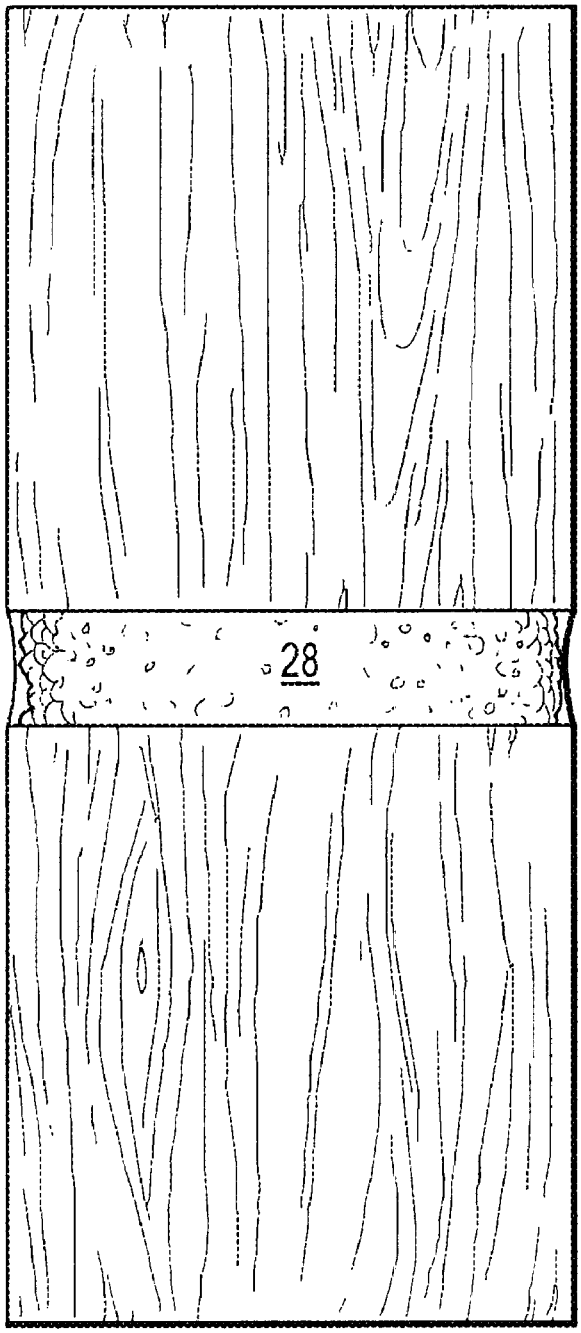
FIG. 10 is the same drawing as FIG. 9 illustrating how the coating material foams after being delivered by the delivery system into the hole.
Figure 11:
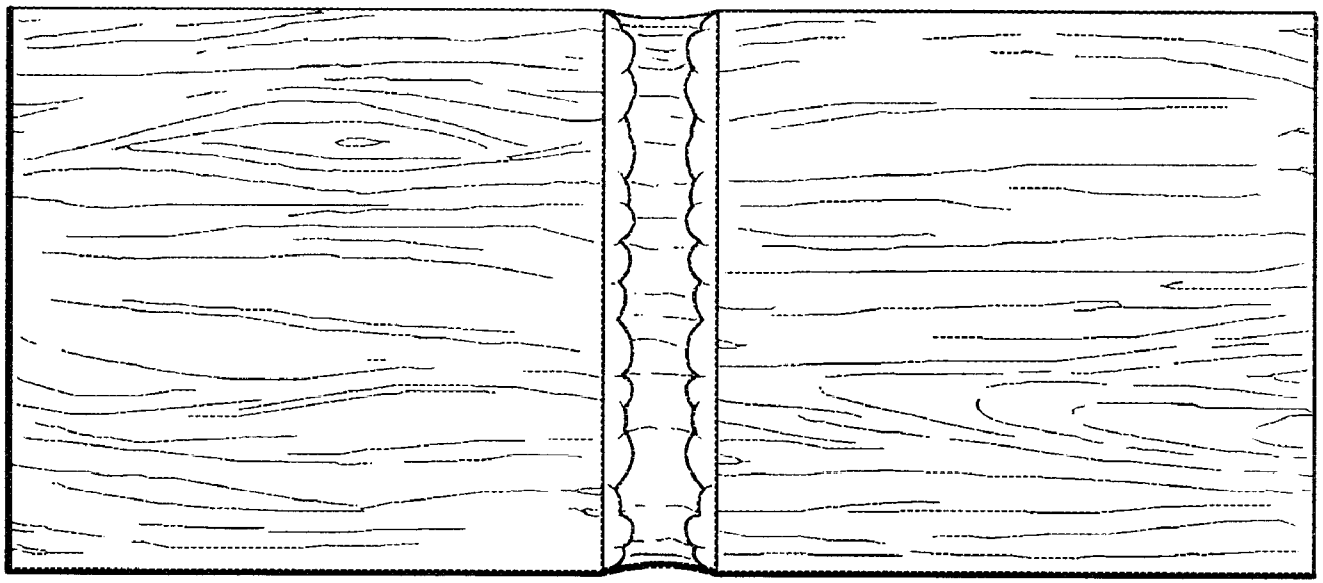
FIG. 11 is the same drawing as FIG. 10 after the foamed coating material has substantially collapsed, while still in a partially foamed state.
Figure 12:
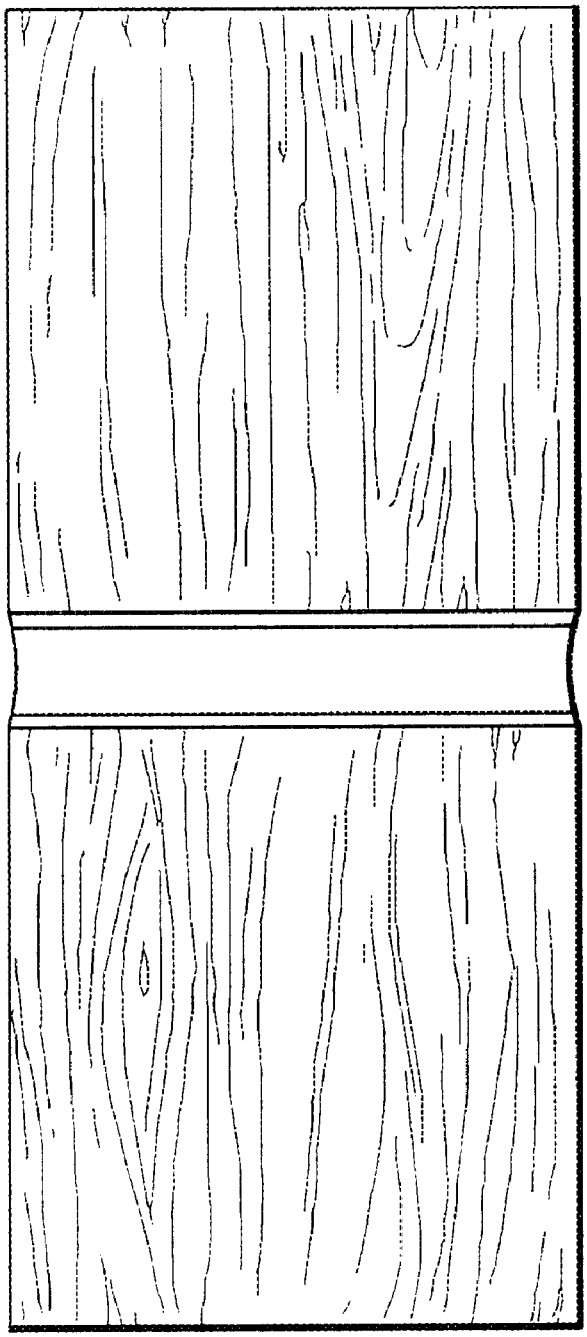
FIG. 12 is the same drawing as FIG. 1, showing a further collapse of the foamed resin material in which there is substantially no foam and in which the resin material to some degree collects at a low point in the hole due to gravity.
Figure 13:
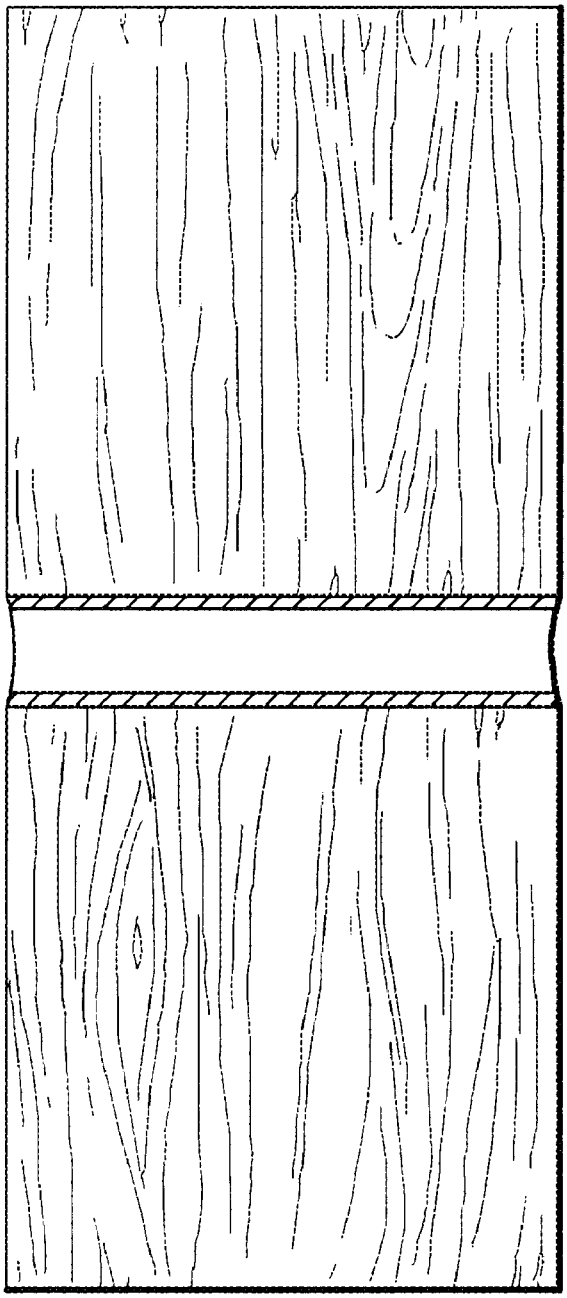
FIG. 13 is the same drawing as FIG. 12 showing how the coating material penetrates and seals the wood surface in the vicinity of the check as the coating material hardens.

As the collapsed foam changes to a liquid and penetrates the wood surface, the liquid coating material gradually hardens. Where the coating material constitutes a polymeric resinous binder, the binder preferably cross-links over a period of approximately two to five days, as shown in FIG. 7. Note also that the coating material seeps into and hardens within the wood surface a relatively great depth in the region of the puddle 30, as shown in FIG. 6.

FIGS. 8–13 essentially show the use of the present invention in the same manner as described with reference to FIGS. 2–7, except in connection with a hole 32 extending horizontally through a utility pole 32.

The coating material may also include a biocide such as a rodenticide, a fungicide, an insecticide or insect repellant, or an herbicide, or any combination of the foregoing types of biocides.

It will be appreciated that the foaming action helps ensure that all sides of wood particles and wood contours are treated with the coating material. The foaming action causes the coating material to defy gravity and to coat even vertically raised areas of the wood surface. Also, the foaming action helps push the resin material under pressure against all sides and irregularities of the wood surface thereby helping to ensure that the resin material coats, adheres to, and penetrates all areas of the wood surface, including tiny fractures and irregularities.

The present invention may be employed as a back-up sealing system for conventionally applied backer rod/caulking systems that may be utilized for relatively large checks in logs. That is, the present invention may be used in such a check initially to provide a sealer coating of the wood surface prior to placing a backer rod and caulking in the check.

The coating material of the present invention is preferably either of two embodiments, one solvent-based, and the other water-based. A suitable solvent-based coating composition might be, for example:

Solvent-based coatings composition:

| Ingredient (with trade name) | Weight Percent Range |
|---|---|
| Linseed Oil (raw or boiled) (Various suppliers) | 25–55 |
| Long oil alkyd resin (Chempol 011-6005) | 5–35 |
| Mineral spirits solvent | 5–10 |
| Ester alcohol (Texanol ™) | 15–25 |
| Ultra-fine titanium dioxide dispersion (Tiosorb UFO1) | 0.5–9 |
| Methyl ethyl ketoxime (Troykyd Anti-Skin B) | 0.1–1 |
| Cobalt drying catalyst (12% Cobalt Cem-All) | 0.02–0.2 |
| Calcium drying catalist (10% Calcium Cem-All) | 0.02–0.2 |
| Drier Accelerator (DRI-$R_x$) | 0.01–0.1 |
| Drier Accelerator (CUR-$R_x$) | 0.02–0.2 |
| Tetrachloroisophthalonitrile (Busal 1192D) | 0.5–1.5 |
| Iodopropynyl butyl carbamate (Troysan Polyphase P-20T) | 0.5–1.5 |

A suitable water-based coating composition might be, for example:

Water-based coatings composition:

| Ingredient (with trade name) | Weight Percent Range |
|---|---|
| Acrylic-modified alkyd resin (Resydrol AY-586) | 35–45 |
| Mineral spirits solvent | 1–4 |
| Water | 44–55 |
| 28% Aqua Ammonia | 0.1–1 |
| Anionic surfactant (Additol XL-250) | 0.1–1 |
| Polysiloxane surfactant (BYK-341) | 0.05–0.5 |
| Silicone-modified mineral oil (BYK-035) | 0.01–0.1 |
| Methyl ethyl ketoxime (Troykyd Anti-Skin B) | 0.05–0.5 |
| Benzotriazol UV Absorber (Tinuvin 1130) | 0.1–1 |
| Piperidinyl sebacate UV light stabilizer (Tinuvin 765) | 0.05–0.5 |
| Cobalt Neodecanoate drier (Cobalt Hydro-Cure II) | 0.1–0.5 |
| Polyurethane associative thickener (Acrysol RM-8W) | 0.1–1 |
| Polyacrylate thickener (Acrysol TT-615) | 0.05–0.5 |
| Dipropylene glycol monomethyl ether (Arcosolve DPM) | 0.5–2 |
| Iodopropynyl butyl carbamate (Troysan Polyphase P-20T) | 0.15–1.5 |
| Flatting silica (Aerosil TS-100) | 0.5–2 |

Some resinous polymers that could be successfully employed as the primary penetrating binder are: polyacrylates, alkyds (long-, medium-, and short-oil versions), silicone-modified alkyds, acrylic-modified alkyds, urethane-modified alkyds, polyvinylidine chlorides, drying vegetable oils (linseed, soybean, tung, walnut, oiticica, safflower, grape seed, etc.), polyvinyl chlorides, polyurethanes, polyvinybutyrals, polysiloxanes, polyesters, epoxies, rubber-modified epoxies, phenolics, epoxy esters, etc.

Other solvents that can be successfully employed to fluidize an appropriate water-repellant coating are: water, mineral spirits, toluene, t-butyl acetate, n-butyl acetate, heptane, perchloroethylene, methyl ethyl ketone, Texanol™, dipropylene glycol monobutyl ether, tripropylene glycol monomethyl ether, kerosene, lacquer thinner, VM&P naphtha, Stoddard solvent, acetone, methyl acetate, parachlorobenzotrifluoride, methylated siloxanes, methylene chloride, etc.

Fungicides that can be successfully used as inhibitors to fungal growth are: [1,2-Benzisothiazolin-3-one], Bis (trichloromethyl) sulfone], 2-Broma-4'-hydroxyacetophenone], 2-Bromo-2-nitropropane- 1,3-diol], [Capryl hydroxyethyl imidazoline],[Captan], [p-Chloro-m-cresol], Chloromethoxy propyl mercuric acetate], [Chloroxylenol], [Cocoalkonium chloride], [Copper linoleate], [Copper Naphthenate], [Copper oxide (ic)], [Copper oxide (ous)], [2,2-Dibromo-3-nitrilopropionamide],[1-{{2-(2,4-Dichlorophenyl)-4-propyl-1,3-dioxolan-2 -yl}-methyl}-1H-1,2,4-triazole], [Diiodomethyl p-tolyl sulfone],[3,5-Dimethyl tetrahydro-2-H, 1,3,5-thiadiazone-2-thione], [Di (phenyl mercury) dodecenyl succinate], [Disodium octaborate tetrahydrate], [7-Ethyl bicyclooxazolidine], [2{(-Hydroxymethyl) aminol ethanol], [2-{(Hydroxmethyl) amino}-2-methylpropanol], [Iodopropynyl butylcarbamate], [Isodecyl oxypropyl amine acetate], [Methylchloroisothiazolinone], [Methyldibromo glutaronitrile], [Methylenebis (thiocynate)]; [Methylisothiazolinone],[1-Methyl-3,5,7,-triaza-1-azoniatricyclo-{3.3.1.1}decane chloride],[2-n-Octyl-4-isothiazolin-3-one],[Phenoxyethanol],[Phenylmercuric acetate],[phenylmercuric oleate],[Quaternium-15],[Sodium hydroxmethylglycinate], [Disodiumtetrahydrate octaborate], [Tetrachloroisophthalonitrile], [Thiabendazole hypophosphite salt], [2-Thiocyanomethylthiobenzothiazole],[p-Toluenesulfonamide],[Tributyltin fluoride],[Tributyltin oxide], [Tributyltin salicylate], [N-Trichloromethylthio phthalimide], [Zinc dimethyldithiocarbamate],[Zinc pyrithione], etc.

Propellants that are suitable for use in connection with the proposed invention are those that are commonly used for other typical aerosol products which can be blended in various ratios to favor varying rates of dispensing and various degrees of foaming that are required for specific applications. Propellants, because of their varying vapor pressures, affect the rate at which foam is created. Also, a large number of surfactants can be included in the coating compositions for the specific purpose of helping to develop a collapsing foam. Common propellants in use today include; ethane, propane, n-butate, iso-butane, pentanes, dimethyl ether, HFC-125, HFC-134a, HFC-152a—and the like, and most preferably propane, n-butane, dimethyl ether, and iso-butane. Other propellants and combinations of propellants could potentially be used by those skilled in the art to deliver satisfactory results.

It has been found that a combination of iso-butane and dimethyl ether (in the ratio of about 22.5/7.5 weight percent—based on the total product weight, i.e., about 30% by weight of total propellant) delivers the most satisfactory combination of flow rate and foam development. Propellants of lower molecular weight (such as propane), at similar proportions in the formula, deliver significantly higher vapor pressures and, therefore, higher flow rates of product (all other things being equal). This higher flow rate offers greater dispensing speed and higher productivity, but at the cost of less application control and product waste. The loss of control and waste occur because the higher flow rate causes the coating, while being dispensed, to either "ricochet" off the back of the recess being treated and blow back into the applicator's face or to the ground, or to displace previously applied product from the recess and blow the freshly-applied foam out of the crevice and to the ground.

On the other hand, when lower vapor-pressure propellants are used, such as pure n-butane, the pressure developed in the container is insufficient to develop good application speed (and hence poor productivity), and does not satisfactorily foam. The foam developed with this latter propellant system is thin and "watery" and does not flow well into the labyrinthine inner structure inside openings typically present in, for instance, log checks.

The total weight of the preferred propellant in the system is to be between 25–35%, with the combination of isobutane and dimethyl ether at a ratio of 22.5 parts iso-butane to 7.5 parts dimethyl ether. Such a system delivers a vapor pressure of about 35 to 45 psi at 70° F., with a flow rate (using an AR83, 802-20-20 valve actuator) of between 0.8 and 1.2 grams of foamed coating per second. This combination of elements delivers a very satisfactory flow rate and excellent-performing foam (which typically collapses back into a thin liquid within about 30 minutes to an hour).

There exists a very large number of surface active agents ("surfactants") that could successfully be used to produce a coating system delivering the foaming performance anticipated by the instant invention. These surfactants are well known in the art. The surfactants found to deliver satisfactory performance for the instant invention are: 3M's fluorosurfactant Fluorad FC-740 (Fluorinated alkyl ester) for the solvent-based version of the proposed invention, and BYK Chemie's polysiloxane-surfactant BYK-341 (polyether-modified poly-dimethyl-polysiloxane) for the water-based version of the proposed invention.

For the solvent-based version of the proposed invention, the weight-percent range of the Fluorad FC-740 found effective in creating a range of foaming levels suitable for various applications has been between about 0.05% (for a very low foaming characteristic) to about 0.5% (for a very high foaming characteristic). This range of surfactants can provide foams that are suitable for not only very small crevices (with a low-foaming characteristic being required) but also for very large openings requiring a much higher foaming characteristic. With this versatility, various versions of the present invention can be provided to the applicator for optimum application functionability. An intermediate level of foaming—at a concentration of about 0.35% surfactant—yields a good overall performance level that can be useful for most applications encountered.

For the water-based version of the instant invention, the weight-percent range of the BYK-341 useful for creating a range of suitable foaming levels is between about 0.1% and about 0.7%, with higher foaming occurring at higher concentrations of surfactant.

Other surfactants—among many others—that can delivery satisfactory foaming performance include: polyoxyethylene oleyl ether, polyoxyethylene lauryl ether, polyoxyethylene cetyl ether, ethoxylated octyl phenols, alkyl polyglucosides, amine oxides, capryl capramidopropyl betaine, cocamidopropyl betaine, sodium cocoyl isethionate, coconut diethanolamine, TEA-lauryl sulfate, sodium trideceth sulfate, sodium octyl sulfate, ammonium laureth sulfate, magnesium lauryl sulfate, sodium decyl sulfate, ammonium alcohol ethoxylate sulfate, sodium alpha olefin sulfate, lauryl ether sulfate, cocamide DEA, cocamidopropyl amine oxide, sodium lauryl sulfate, dimethyl myristyl amine oxide, sodium tridecyl sulfate, lauryl dimethylamine oxide, isopropylamine branched alkylbenzene aryl sulfonate, sodium alpha olefin sulfonate, coco sulfobetaine, disodium laureth sulfosuccinate, etc.

Although particular embodiments of the particular invention are described and illustrations herein, it should be recognized that modifications and variations may readily occur to those skilled in the art and that such modifications and variations may be made without departing from the spirit and scope of our invention. Consequently, our invention as claimed below may be practiced otherwise than as specifically described above.

What is claimed is:

1. A method of applying a substantially waterproof coating to a recessed interior surface of a wood object disposed substantially more than about one centimeter inside the general peripheral surface of said wood object, said recessed interior surface formed from the group consisting of checks, cracks, cuts, crevices, and holes, comprising the steps of:

providing a coating delivery system comprising:

(a) a substantially closed vessel containing under pressure a liquid capable of hardening into a substantially solid coating and a foaming agent;

(b) a nozzle comprising a substantially elongated tube possessing a distal end;

(c) manually actuated valve mounted on said vessel and disposed in operative communication with said liquid and said foaming agent and the interior of said tube such that when said valve assumes a closed position said liquid and said foaming agent are substantially prevented from flowing into the interior of said tube, and when said valve assumes an open position said liquid and said foaming agent flow under pressure through the interior of said tube and out a distal end of said tube;

manipulating said distal end to a position immediately adjacent to said recessed interior surface;

manually actuating said valve whereby said liquid and said foaming agent are delivered through said distal end onto said recessed interior surface such that said liquid foams and such that thereafter said foamed liquid substantially completely collapses into a coating covering said recessed interior surface and;

allowing said collapsed liquid to harden into a substantially solid coating that substantially penetrates said recessed interior surface and substantially seals said recessed interior surface against water intrusion.

2. A method to claim 1 wherein said liquid foams and expands to a volume in the range of substantially 4 to 10 times the volume of said liquid in an unfoamed condition.

3. A method according to claim 1 wherein said liquid foams and expands to a volume in the range of substantially 2 to 20 times the volume of said liquid in an unfoamed condition.

4. A method according to claim 1 wherein said liquid foams and expands to a volume in the range of substantially 20 to 200 times the volume of said liquid in an unfoamed condition.

5. A method according to claim 1 wherein said liquid includes at least one biocide.

6. A method according to claim 5 wherein said at least one biocide is selected from the group consisting of: rodenticide, fungicide, insecticide, and herbicide.

7. A method according to claim 1 wherein said liquid consists essentially of a polymeric resin binder.

8. A method according to claim 7 wherein said polymeric resin binder is selected from the group consisting of alkyd and vegetable oil resins and water reducible acrylic modified alkyds.

9. A method according to claim 7 wherein said liquid consists essentially of a solvent based composition.

10. A method according to claim 7 wherein said liquid consists essentially of a water based composition.

11. A method according to claim 7 wherein said binder slowly cross links over about two to five days after said liquid is delivered onto said wood surface.

* * * * *